United States Patent [19]

Fukunishi et al.

[11] 4,148,628

[45] Apr. 10, 1979

[54] PROCESS OF PRODUCING METALLIC CHROMIUM

[75] Inventors: Takumi Fukunishi, Machida; Masamichi Miura, Sagamihara, both of Japan

[73] Assignee: Toyo Soda Manufacturing Co., Ltd., Shinnanyo, Japan

[21] Appl. No.: 878,080

[22] Filed: Feb. 15, 1978

[30] Foreign Application Priority Data

| | | | |
|---|---|---|---|
| Feb. 18, 1977 | [JP] | Japan | 52-16026 |
| Feb. 21, 1977 | [JP] | Japan | 52-17214 |
| Feb. 21, 1977 | [JP] | Japan | 52-17215 |

[51] Int. Cl.[2] ..... C22B 39/00

[52] U.S. Cl. ..... 75/10 R; 75/84

[58] Field of Search ..... 75/84, 10 R, 26

[56] References Cited

U.S. PATENT DOCUMENTS

| | | | |
|---|---|---|---|
| 2,074,819 | 3/1937 | Weitzenkorn | 75/10 R |
| 3,232,746 | 2/1966 | Karlovitz | 75/10 R |
| 3,502,461 | 3/1970 | Guttler et al. | 75/10 R |

*Primary Examiner*—M. J. Andrews

*Attorney, Agent, or Firm*—Cushman, Darby & Cushman

[57] ABSTRACT

Disclosed is a process of producing metallic chromium by carbon reduction of chromium oxide, wherein granules prepared from a mixture of a finely divided chromium oxide, a finely divided carbon and a binder are passed, while being carried by a gas stream, through a plasma flame. The metallic chromium product is preferably further subjected to refining, either by heating the product to at least 1,200° C. at a reduced pressure in a vacuum furnace or by irradiating the product with a plasma flame in a protective atmosphere.

12 Claims, 1 Drawing Figure

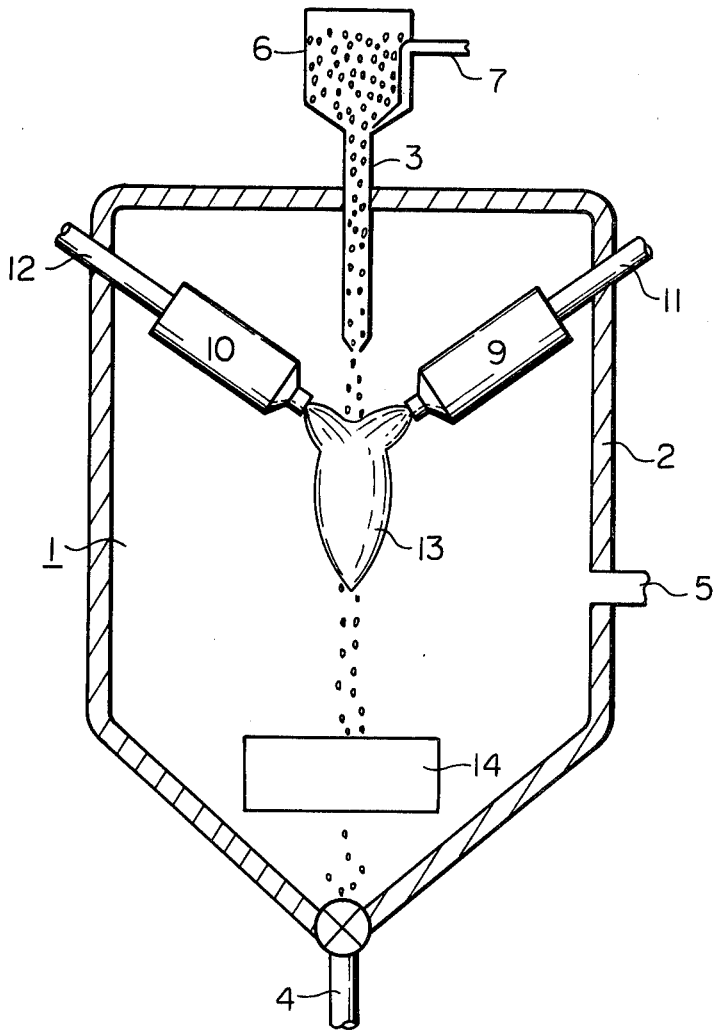
6
7
3
12
11
10
9
2
1
13
5
14
4

PROCESS OF PRODUCING METALLIC CHROMIUM

BACKGROUND OF THE INVENTION

This invention relates to a process for producing metallic chromium by the carbon reduction of chromium oxide wherein plasma is used.

Metallic chromium is generally produced by Thermit reduction of chromium oxide or chromite, or by electrolysis of a chromium salt solution.

It also has been proposed to produce metallic chromium by carbon reduction of chromium oxide wherein chromium oxide briquettes or the like, compression molded from finely divided chromium oxide by using a binder, are heated to a temperature of at least 1,200° C., under vacuum or in a protective atmosphere, in a furnace. This carbon reduction process is, however, not advantageous from the standpoint. That the reduction reaction requires a long period of time and is not efficient. Furthermore, the produced metallic chromium is in a sponge-like form of a small bulk density and, hence, not convenient for being molten in the course of producing Nichrome, heat- and corrosion-resisting steels and other chromium alloys. In addition, when the carbon reduction is conducted under vacuum, evaporation loss of chromium conspicuously occurs because of chromium's enhanced vapor pressure.

A main object of the present invention is to obviate the above-mentioned defects of the known carbon reduction process, i.e. to provide a carbon reduction process wherein the reduction of chromium oxide is efficiently effected in an extremely short period of time.

Other objects and advantages of the present invention will be apparent from the following description.

DETAILED DESCRIPTION OF THE INVENTION

In accordance with the present invention there is provided a process of producing metallic chromium by carbon reduction of chromium oxide wherein agglomerates prepared from a mixture of chromium oxide, carbon and a binder are exposed to an elevated temperature of at least 1,200° C., characterized in that granules prepared from a mixture of a finely divided chromium oxide, a finely divided carbon and a binder are passed, while being carried by a gas stream, through a plasma flame.

The finely divided chromium oxide used in the process of the invention preferably possess a particle size similar to those which are popularly used as abrasive grains or pigments, i.e., 0.5 to 50 micron at average. When the particle size is too large, the rate of the reduction reaction occurring in contact with the plasma flame is liable to be small.

The type of finely divided carbon used in the invention is not critical. Carbon black, graphite, petroleum coke, and their mixtures may conveniently be used. The amount of the finely divided carbon is preferably within the range of 90% to 120% of the stoichiometric amount determined by the following reaction formula.

$$Cr_2O_3 + 3C \rightarrow 2Cr + 3CO\uparrow \quad (1)$$

When the amount of the finely divided carbon is smaller than the lower limit of the above range, the rate of the reduction reaction is undesirably low. In contrast, the use of the finely divided carbon in an amount exceeding the upper limit of the above range is not econimical and produces a product containing an undesirably large amount of carbon.

As the binder used in the invention, water-soluble organic polymeric materials, such as polyvinyl alcohol and α-starch are conveniently used. It is preferable that these organic polymeric materials be used in an aqueous solution form of 3 to 20% by weight concentration. The amount of the binder used may be varied depending upon the particular binder and the particle sizes of the finely divided carbon and chromium oxide. However, the amount of the binder is preferably 5 to 20% by weight, based on the total weight of the finely divided chromium oxide and carbon, and expressed in terms of the weight of the aqueous solution.

Granulation of a mixture of the finely divided chromium oxide powder, the finely divided carbon powder and the binder may be carried out in a known manner, by using a conventional mixer and granulator or pelletizer. The granules so prepared preferably possess a particle size such that the granules are capable of being readily carried by a gas stream and smoothly introduced into a plasma flame, and the carbon reduction occurs with an enhanced efficiency. A suitable particle size is 0.01 to 3 mm, preferably 0.01 to 1 mm.

A plasma furnace of the type which is equipped with a quenching device and in which the atmosphere can be adjusted is used in the process of the invention. The plasma furnace may be either an arc or high-frequency induction furnace. The electric current applied thereto may be either direct or alternating.

BRIEF DESCRIPTION OF THE DRAWING

FIG. 1 is a cross-sectional view showing one example of the plasma furnaces used in the process of the invention.

DESCRIPTION OF THE DRAWING

In FIG. 1, the plasma furnace 1 is provided at the top of its furnace wall 2 with a granule feeding device comprised of a hopper 6, a carrier gas supplying pipe 7 and a granule feeding pipe 3. The furnace 1 is further provided with an exhaust pipe 5 and a reduced product outlet pipe 4 at the side and bottom, respectively, of its furnace wall 2. Plasma torches 9 and 10 are provided inside the furnace, and a gas is supplied thereto through gas inlet pipes 11 and 12.

Granules of the chromium oxide-carbon mixture are carried by a carrier gas, such as argon, hydrogen, methane or mixtures of those, supplied through the gas supplying pipe 7, and flow down through the feeding pipe 3 and into a plasma flame 13 where the granules are exposed to high temperature. This high temperature permits the rapid reduction of chromium oxide. The residence time of the granules in the plasma flame may be suitably varied by changing the length of the plasma flame. For example, the length of the plasma flame is magnified by increasing the power given to plasma generators or arranging a plurality of plasma torches so that they are located one over another vertically. The heated granules fall down on a cooling means 14 comprising a water-cooled plate, and the cooled granules are withdrawn through the outlet pipe 4.

The gas supplied to the plasma torches is preferably argon or a gaseous mixture, such as argon plus hydrogen, argon plus methane or hydrogen plus methane. The proportion of the ingredients in the gaseous mixture may be suitably varied depending upon the desired plasma temperature. The temperature, at which the granules are heated by being contacted with the plasma flame, is usually within the range of from approximately 2,000° to approximately 3,000° C.

While falling through the plasma flame, carbon rapidly reacts with chromium oxide to produce metallic chromium. The length of time required for the reduction is extremely short, because the $Cr_2O_3$—C granules are reduced while falling through the plasma flame. Thus, the process of the present invention is advantageous over hithertofore proposed carbon reduction processes.

The reduced product withdrawn from the plasma furnace contains minor amounts of non-metallic materials, i.e., usually 0.5 to 3% by weight of oxygen and 0.5 to 3% by weight of carbon. Thus, it is advantageous for the reduced product withdrawn from the plasma furnace to be further subjected to a refining treatment, so that metallic chromium of high purity will be produced. Such a refining treatment may be effected as follows.

First, the reduced product withdrawn from the plasma furnace is cooled and pulverized into particles, preferably of an average particle size of approximately 0.05 to 0.08 mm. The pulverized particles are milled with a binder and, if desired, a finely divided carbon. Then, the milled mixture is molded into briquettes, and then, dried.

The binder used may be the same as that used for the preparation of the granules to be treated in the plasma furnace, i.e. water-soluble organic polymeric materials, such as polyvinyl alcohol and α-starch. The amount of the binder used may be determined within the range of from 5 to 20% by weight, based on the total weight of the pulverized product and the optional finely divided carbon and expressed in terms of the weight of the aqueous solution, although the suitable amount varies depending upon the particular binder and the particle sizes of the pulverized product and the optional finely divided carbon.

The finely divided carbon, which is optionally (i.e., if desired) used, may be the same as that used for the carbon reduction in the plasma furnace. Although the suitable amount of the finely divided carbon varies depending upon the amounts of oxygen and carbon contained in the reduced product from the plasma furnace, the amount of the finely divided carbon is preferably within the range of from 90 to 110% of the stoichiometric amount. This stoichiometric amount is determined by calculating the amount of oxygen contained in the reduced product from the plasma furnace in terms of the amount of $Cr_2O_3$ and, further, calculating the stoichiometric amount of carbon required for reducing said amount of $Cr_2O_3$ according to the reaction formula (1), mentioned hereinbefore.

The dried briquettes are then refined as follows. In a first method, the briquettes are heated at a reduced pressure of from 0.1 to 20 Torr, in a vacuum furnace, whereby the briquettes are subjected to a solid phase reduction. The vacuum furnace is preferably of the type which is equipped with an electrical resistance heater. The pressure within the vacuum furnace should be maintained within the above-mentioned pressure range because, when the degree of vacuum is larger, the evaporation loss of chromium becomes conspicuous. The temperature, to which the briquettes are exposed within the vacuum furnace is at least 1,200° C., preferably from 1,200° to 1,500° C. The reaction time may be short, i.e., usually 3 to 4 hours, because only a minor amount of $Cr_2O_3$ is contained in the briquettes.

In a second method, the briquettes are placed in a water-cooled metal vessel provided in a plasma furnace, where the briquettes are exposed to plasma flame radiation in a protective atmosphere, thereby to be subjected to reduction in a molten state. The water-cooled vessel is preferably made of copper, and the plasma furnace is airtight-sealable so that a completely protective atmosphere may be maintained.

In the above-mentioned second method, the gas to be converted into a plasma may be the same as that used for the reduction of granules of the $Cr_2O_3$ mixture mentioned hereinbefore. The length of the irradiation time with the plasma flame may be varied within the range of from 1 to 30 minutes. The briquettes are heated to a temperature of approximately 1,900° to 2,000° C., usually approximately 2,000° C., by the irradiation with the plasma flame, whereby $Cr_2O_3$ is reduced in a molten state. The protective atmosphere is formed of a gas which is inert to metallic chromium, such as argon, or a mixture of argon plus hydrogen or argon plus methane. The refined metallic chromium product is collected, preferably by casting the molten product in a mold within the plasma furnace, followed by its withdrawal from the furnace.

The metallic chromium product reduced in a molten state in the above-mentioned second method may be subjected to decarbonization in order to furhter enhance the purity of the metallic chromium product. This decarbonization is advantageous particularly when the molten state reduction in the above-mentioned second method is effected by using a plasma flame formed by the conversion from not argon-hydrogen, but argon or argon-methane. The decarbonization is carried out in the plasma furnace by irradiating, in the absence of hydrogen, the metallic chromium product with a plasma flame converted from a gaseous mixture of argon and oxygen.

The metallic chromium product obtained by either of the above-mentioned two refining methods contains only trace amounts of non-metallic materials, such as carbon and oxygen, i.e., possesses a purity of higher than 99%, and hence, is excellent in quality. Since the length of time during which the briquettes are exposed to the elevated temperature may be extremely short, the evaporation loss of chromium is almost negligible.

Furthermore, the bulk density of the metallic chromium is high. Particularly, that of the metallic chromium obtained by the above-mentioned second method reaches 6 to 7 g/ml, because the reduction is conducted in a molten state. Thus, the metallic chromium product is advantageously used for the production of Nichrome, heat- and corrosion-resistant steels and other chromium alloys.

The invention will be described in more detail in the following examples, in which parts and percents are by weight, unless otherwise specified.

EXAMPLE 1

0.13 part of an aqueous 5% polyvinyl alcohol solution was added to a mixture of 10 parts of a finely divided chromium oxide ($Cr_2O_3$) and 2.5 parts of a finely divided carbon black. The mixture was milled and granulated into granules of approximately 2 mm in particle size.

The granules were subjected to carbon reduction by using a plasma furnace which was similar to that shown in FIG. 1 and equipped with six plasma torches. Argon was used as the carrier gas, and a gaseous mixture (1:1 by volume) of argon and hydrogen was used as the plasma source.

6.6 parts of a metallic chromiun product were collected from the furnace, which were found to be of the following composition, and to have a bulk density of 4.5 g/ml.

Chromium—99.09%
Carbon—0.24%
Oxygen—0.031%
Metallic impurities—0.46%

EXAMPLE 2

0.15 part of an aqueous 5% α-starch solution was added to a mixture of 10 parts of a finely divided chromium oxide ($Cr_2O_3$) and 2.0 parts of a finely divided graphite. The mixture was milled and granulated into granules of approximately 0.5 mm in particle size.

The granules were subjected to carbon reduction by using a plasma furnace similar to that used in Example 1 and under conditions similar to those set forth in Example 1, wherein a gaseous mixture (1:2 by volume) of hydrogen and methane was used as the plasma source.

6.6 parts of a metallic chromium product were collected from the furnace, which were found to contain 0.30% of oxygen and 0.28% of carbon, and to have a bulk density of 4.7 g/ml.

EXAMPLE 3

0.25 part of an aqueous 10% polyvinyl alcohol solution was added to a mixture of 20 parts of a finely divided chromium oxide ($Cr_2O_3$) and 4.5 parts of graphite. The mixture was milled and granulated into granules of approximately 2 mm in particle size.

The granules were subjected to carbon reduction by using a plasma furnace similar to that used in Example 1 and under conditions similar to those set forth in Example 1, wherein a gaseous mixture (3:1 by volume) of argon and hydrogen was used as the plasma source. 14 parts of a metallic chromium product were collected from the furnace, which were found to contain 1.2% of oxygen and 0.89% of carbon, and to have bulk density of 4.4 g/ml.

The metallic chromium product was pulverized into particles of approximately 0.07 mm in particle size. 10 parts of the particles were mixed with 0.1 part of a finely divided graphite. 0.1 part of an aqueous 10% polyvinyl alcohol solution was added to the chromium-graphite mixture. The resulting mixture was milled and, then, compression-molded, at a pressure of 4 ton/cm$^2$, into briquettes having a 32×25×17 mm size. After being dried, the briquettes were placed in a vacuum furnace equipped with an electrical resistance heater, where the briquettes were maintained at a temperature of 1,400° C. and a pressure of approximately 8 Torr, for a period of 3 hours.

9.5 parts of a metallic chromium product were collected from the vacuum furnace, which were found to be composed of 99.47% metallic chromium, 0.02% oxygen, 0.03% of carbon and 0.48% metallic impurities, and to have a bulk density of 5.1 g/ml.

EXAMPLE 4

0.2 part of an aqueous 5% polyvinyl alcohol solution was incorporated in a mixture of 20 parts of finely divided chromium oxide ($Cr_2O_3$) and 4.2 parts of a finely divided carbon black. The mixture was milled and granulated into granules of approximately 1 mm in particle size.

The granules were subjected to carbon reduction by using a plasma furnace similar to that used in Example 1 and under conditions similar to those set forth in Example 1, wherein a gaseous mixture (4:1 by volume) of hydrogen and methane was used as the plasma source. 13.9 parts of a metallic chromium product were collected from the plasma furnace, which were found to contain 0.85% of oxygen and 0.64% of carbon, and to have a bulk density of 4.5 g/ml.

Briquettes having a 32×25×17 mm size were prepared from 10 parts of the metallic chromium product in a manner similar to that set forth in Example 3. After being dried, the briquettes were placed in a vacuum furnace with an electrical resistance heater, where the briquettes were maintained at a temperature of 1,400° C. and a pressure of approximately 8 Torr, for a period of 4 hours.

9.6 parts of a metallic chronium product were collected from the vacuum furnace, which were found to be composed of 99.32% metallic chromium, 0.02% oxygen, 0.03% carbon and 0.49% metallic impurities, and to have a bulk density of 5.0 g/ml.

EXAMPLE 5

0.3 part of an aqueous 3% polyvinyl alcohol solution was incorporated in a mixture of 20 parts of a finely divided chromium oxide ($Cr_2O_3$) and 4.5 parts of a finely divided carbon black. The mixture was milled and granulated into granules of approximately 2 mm in particle size.

The granules were subjected to carbon reduction in a manner similar to that set forth in Example 1, wherein a gaseous mixture (1:3 by volume) of argon and hydrogen was used as the plasma source. 13.8 parts of a metallic chromium product were collected from the plasma furnace, which were found to contain 0.71% of oxygen and 0.53% of carbon, and to have a bulk density of 4.9 g/ml.

Briquettes having a 10×5×5 mm size were prepared from 10 parts of the metallic chromium product in a manner similar to that set forth in Example 3, wherein 0.05 part of a finely divided carbon black and 0.13 part of an aqueous 3% polyvinyl alcohol solution were used per 10 parts of the pulverized product particle. After being dried, the briquettes were placed in a water-cooled copper vessel provided in an airtight sealable plasma furnace. After the furnace was flushed with a gaseous mixture of argon and hydrogen, the briquettes were irradiated, in the argon-hydrogen atmosphere, with a plasma flame converted from a gaseous mixture (1:3 by volume) of argon and hydrogen. By the irradiation, the briquettes were heated to approximately 2,000° C. and reduced in a molten state. The molten product was cast into a mold and withdrawn from the furnace.

9.5 parts of a metallic chromium product were collected, and it was found to be composed of 99.05% metallic chromium, 0.20% oxygen, 0.28% carbon and 0.47% metallic impurities, and to have a bulk density of 6.8 1 g/ml.

EXAMPLE 6

0.3 part of an aqueous 5% α-starch solution was incorporated in a mixture of 20 parts of a finely divided chromium oxide ($Cr_2O_3$) and 5.0 parts of a finely divided graphite. The mixture was milled and granulated into granules of approximately 0.8 mm in particle size.

The granules were subjected to carbon reduction in a manner similar to that set forth in Example 1, wherein a gaseous mixture (1:4 by volume) of hydrogen and methane was used as the plasma source. 13.8 parts of a metallic chromium product were collected from the plasma surface, which were found to contain 0.75% of oxygen and 0.52% of carbon, and to have a bulk density of 4.6 g/ml.

Briquettes having a 10×5×5 mm size were prepared from 10 parts of the metallic chromium product in a manner similar to that set forth in Example 5. After being dried, the briquettes were refined by a plasma flame irradiation in a manner similar to that set forth in Example 5, wherein a gaseous mixture (1:4 by volume) of hydrogen and methane was used as the plasma source instead of the argon-hydrogen mixture.

9.6 parts of a metallic chromium product were collected. This product was found to be composed of 99.12% metallic chromium, 0.18% oxygen, 0.25% carbon and 0.45% metallic impurities, and to have a bulk density of 6.8 g/ml.

The metallic chromium product so obtained was further subjected to decarbonization as follows. After the plasma furnace was flushed with argon, the metallic chromium product was again placed in the above-mentioned water-cooled copper vessel, and irradiated, in an argon atmosphere, with a plasma flame converted from a gaseous mixture of argon and oxygen. The metallic chromium product so refined was found to contain 0.07% of oxygen and 0.05% of carbon.

What we claim is:

1. In a process of producing metallic chromium by carbon reduction of chromium oxide wherein a mixture of chromium oxide and carbon is exposed to an elevated temperature of at least 1,200° thereby to reduce the chromium oxide, and the thus reduced metallic chromium product is recovered, the improvement comprising conducting said process using granules having an average particle size of from 0.01 to 3 mm prepared from a mixture of a finely divided chromium oxide, a finely divided carbon and a binder are passed, while being carried by a gas stream, through a plasma flame.

2. A process according to claim 1 wherein the finely divided carbon is at least one material selected from the group consisting of carbon black, graphite and petroleum coke.

3. A process according to claim 1 wherein the binder is an aqueous solution of a water-soluble organic polymeric material.

4. A process according to claim 3 wherein the organic polymeric material is at least one material selected from the group consisting of polyvinyl alcohol and α-starch.

5. A process according to claim 1 wherein the plasma is converted from an argon or a gaseous mixture selected from the group consisting of argon-hydrogen, argon-methane and hydrogen-methane.

6. A process according to claim 1 wherein the recovered reduced metallic chromium product obtained by being passed through the plasma flame is cooled and pulverized into particles, the particles are molded into briquettes by using a binder, and then, the briquettes are further subjected to reinfing thereby enhancing the purity of metallic chromium in the recovered reduced metallic chromium product wherein the reduced metallic chromium product is further subjected to carbon reduction, and then recovered.

7. A process according to claim 6 wherein the briquettes are molded from a mixture of the metallic chromium product particle, a finely divided carobn and a binder.

8. A process according to claim 6 wherein said refining is carried out by placing the briquettes in a vacuum furnace maintained at a temperature of at least 1,200° C. and a reduced pressure of 0.1 to 20 Torr, whereby the briquettes are reduced in a solid phase.

9. A process according to claim 8 wherein the briquettes are maintained at a temperature of from 1,200° C. to 1,500° C.

10. A process according to claim 6 wherein said refining is carried out by placing the briquettes in a water-cooled metal vessel provided in a plasma furnace and irradiating the briquettes with a plasma flame in a protective atmosphere, whereby the briquettes are reduced in a molten state.

11. A process according to claim 10 wherein the plasma flame is formed by the conversion from a gas selected from the group consisting of argon, an argon-methane mixture and an argon-hydrogen mixture.

12. A process according to claim 10 wherein the plasma flame formed by the conversion from a gas of argon or an argon-methane mixture is used in said refining, and the metallic chromium product obtained by said refining is further refined for the decarbonization thereof in said plasma furnace by irradiating, in the absence of hydrogen, the metallic chromium product with a plasma flame converted from a gaseous mixture of argon and oxygen.

* * * * *